US008198561B2

(12) United States Patent
Godesa

(10) Patent No.: US 8,198,561 B2
(45) Date of Patent: Jun. 12, 2012

(54) SWITCHING MECHANISM FOR A SWITCHING DEVICE HAVING A SWITCHING LEVER WHICH REMAINS IN AN INTERMEDIATE SWITCH POSITION WHEN A CONTACT ELEMENT IS WELDED AND WHEN AN OPENING OPERATION IS CARRIED OUT

(75) Inventor: Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 312 days.

(21) Appl. No.: 12/695,426

(22) Filed: Jan. 28, 2010

(65) Prior Publication Data

US 2010/0193339 A1 Aug. 5, 2010

(30) Foreign Application Priority Data

Jan. 30, 2009 (DE) ..... 10 2009 007 475

(51) Int. Cl.
*H01H 5/00* (2006.01)

(52) U.S. Cl. ..... 200/400; 200/244; 200/401

(58) Field of Classification Search ..... 200/17 R, 200/400, 401, 244, 334; 335/2, 6, 15, 16, 335/21, 70, 147, 166, 172, 191, 195, 202
See application file for complete search history.

(56) References Cited

U.S. PATENT DOCUMENTS 3,614,685 A 10/1971 Ellsworth
4,129,762 A * 12/1978 Bruchet ..... 200/401
4,546,224 A * 10/1985 Mostosi ..... 200/401
5,142,112 A * 8/1992 Parks et al. ..... 200/401
5,270,564 A * 12/1993 Parks et al. ..... 200/401
5,304,765 A * 4/1994 Parks et al. ..... 200/401
5,369,384 A 11/1994 Heins
6,084,191 A * 7/2000 Kataya et al. ..... 200/401
6,166,344 A * 12/2000 Castonguay et al. ..... 200/401
6,911,614 B2 * 6/2005 Asano et al. ..... 200/401

FOREIGN PATENT DOCUMENTS

DE 4227213 A1 2/1994
DE 60033632 T2 10/2007
EP 0325767 B1 4/1994
EP 1039499 A2 9/2000

(Continued)

*Primary Examiner* — Michael Friedhofer
(74) *Attorney, Agent, or Firm* — Harness, Dickey & Pierce, P.L.C.

(57) ABSTRACT

A switching mechanism for a switching device is disclosed. In at least one embodiment, the switching mechanism includes a contact element which is mounted in a switching shaft segment such that it can rotate and can be switched off automatically in the event of a fault via said switching mechanism, a switching lever for switching the contact element on and off manually; a cocking lever which is mounted in a fixed position such that it can rotate and interacts with a catch; and a toggle lever joint including a coupling lug for connection to the contact element, a pivoting lever and a toggle lever joint shaft. The switching lever can assume at least one switched-on position, a manual switched-off position or automatically unlatched tripped position, or an intermediate switch position which is located between the switched-on position and the tripped position when a contact element is welded. According to at least one embodiment of the invention, the switching link of the switching lever has at least one blocking element, which interacts with the coupling lug such that the switching lever remains in the intermediate switch position if an opening operation is carried out when a contact element is welded.

18 Claims, 7 Drawing Sheets

FOREIGN PATENT DOCUMENTS

| | | |
|---|---|---|
| EP | 1 143 477 | 10/2001 |
| EP | 1 455 374 | 9/2004 |
| EP | 1455374 B1 | 6/2007 |
| EP | 2061058 A1 | 5/2009 |

* cited by examiner

SWITCHING MECHANISM FOR A SWITCHING DEVICE HAVING A SWITCHING LEVER WHICH REMAINS IN AN INTERMEDIATE SWITCH POSITION WHEN A CONTACT ELEMENT IS WELDED AND WHEN AN OPENING OPERATION IS CARRIED OUT

PRIORITY STATEMENT

The present application hereby claims priority under 35 U.S.C. §119 on German patent application number DE 10 2009 007 475.9 filed Jan. 30, 2009, the entire contents of which are hereby incorporated herein by reference.

FIELD

At least one embodiment of the invention generally relates to a switching mechanism for a switching device, in particular for a low-voltage circuit breaker.

At least one embodiment relates to a switching mechanism which has at least one contact element which is mounted in a switching shaft segment and can be switched off automatically in the event of a fault via the switching mechanism, as well as a switching lever for switching the contact element on and off manually. The switching lever has a switching link which can be tilted about a fixed-position bearing point. The switching mechanism furthermore has a cocking lever which is mounted such that it can rotate about a fixed-position cocking lever axis and has at an opposite end, which interacts with a catch, for latching and unlatching the cocking lever, and a toggle lever joint, comprising a coupling lug, a pivoting lever and a toggle lever joint shaft which connects them. The coupling lug is connected on the other side to the contact element and the pivoting lever is connected on the other side to the cocking lever. Furthermore, the switching mechanism has a spring element which is introduced between the toggle lever joint shaft and the switching lever. In this case, the switching lever can assume at least one switched-on position, in which the spring element moves the toggle lever joint to an extended position, a manual switched-off position or automatically unlatched tripped position, in which the spring element moves the toggle lever joint to a bent position, or an intermediate switch position which is located between the switched-on position and the tripped position when a contact element is welded.

In the specialist world, the tripped position is also referred to as the TRIP position. In this case, "automatically" means that the switching contacts automatically open under the influence of a release in the event of a fault, in particular in the event of a short circuit or overcurrent.

Furthermore, at least one embodiment of the invention relates to a switching device having a double-interrupting or single-interrupting rotating contact system which is accommodated in an insulating material housing, has two fixed contacts for connection to a respective current path as well as a contact element which is mounted in a switching shaft segment such that it can rotate and interacts with at least one of the fixed contacts. The contact element can be switched off automatically in the event of a fault via a switching mechanism such as this.

In particular, at least one embodiment of the invention relates to switching devices in the low-voltage range. "Low-voltage" typically means voltages of up to about 1000 volts. With an appropriate design embodiment of the switching isolating gaps, switching devices such as these can also be designed for switching voltages above 1000 V, for example up to 6.3 kV. Furthermore, switching devices such as these are designed in particular to interrupt current paths in the event of an overcurrent or in the event of a short-circuit. They may be designed to have one or more poles, in particular three poles.

BACKGROUND

European Patent EP 1 455 374 B1 discloses a low-voltage isolating switch which has at least one moving contact, which can be connected to and disconnected from a corresponding fixed contact, as well as a positive-opening device. The latter has a moving element which is associated with the moving contact, a first drive train which is operatively connected to the moving contact and to an actuating device, as well as a second drive train, which is connected to the moving element and to the first drive train. A first lever is associated with the first drive train, and a second lever is associated with the second drive train. The first and second levers interact with one another during the opening operation. Both levers are provided with blocking devices for the situation in which the contacts are welded to one another.

SUMMARY

In at least one embodiment of the invention a switching mechanism of simpler design and which requires fewer components is disclosed.

In at least one embodiment of the invention a suitable switching device having a switching mechanism such as this is disclosed.

According to at least one embodiment of the invention, the switching link of the switching lever has at least one blocking element, which interacts with the coupling lug such that the switching lever remains in the intermediate switch position if an opening operation is carried out when a contact element is welded. A welded contact element means that the switching piece of a moving switching contact is welded or stuck to the switching piece of an interacting fixed contact.

The essence of at least one embodiment of the invention is that the switching shaft segment can rotate only through a rotation angle which is relatively small in comparison with a serviceable contact element, for example to only 5° instead of 7.5°, in the event of automatic tripping of the switching mechanism and if the contact element is welded or stuck at the same time. The spring element therefore "pulls" the toggle lever joint to the extended position, in which case the coupling lug or the lower toggle lever is then pulled to a position in which it can block the switching link of the switching lever. The switching lever then remains in a switch position between the switched-on position and the tripped position (TRIP position). A user can immediately visually see that the switching device has behaved incorrectly.

The particular advantage of the switching mechanism according to at least one embodiment of the invention is the considerably simple design and the reduced number of components. In comparison to the prior art mentioned initially, no additional first and second levers are required here.

According to one embodiment, the coupling lug or the lower toggle lever has a hook piece which is arranged in the area of the toggle lever joint shaft. If a contact element is welded, this hook piece is, so to speak, "in the way" of the blocking element of the switching link. The hook piece is preferably advantageously "only" a small projection at the side on the coupling lug.

It is particularly advantageous for the coupling lug together with the hook piece to be a stamped part. The coupling lugs can therefore be produced particularly easily.

In a further embodiment, the switching link is a stamped and bent part, and the at least one blocking element is a stamped-around, bent-around stamped and bent piece. This allows simple integration of the blocking element in the switching link, in a reasonably simple manner. In particular, the stamped and bent piece is formed at a tangential end of the switching link. In this case, "tangential" means directions around a fixed-position tilting axis of the switching link or of the switching lever.

It is also advantageous for the at least one blocking element of the switching link and the hook piece of the coupling lug to be mechanically designed to withstand loads such that at least one attempt can be made to break open the welded contact element by manual operation of the switching lever in the direction of the switched-off position. This advantageously allows emergency disconnection, for example of a load which is connected to the switching device.

At least one embodiment of the invention is also achieved by a switching device having a double-interrupting or single-interrupting rotating contact system which is accommodated in an insulating material housing.

In the case of a double-interrupting rotating contact system, one contact lever with two contact arms is typically mounted in the switching shaft segment as the contact element. At its outer end, each contact arm has a moving switching contact which interacts with in each one associated, opposite fixed contact. The two fixed contacts are firmly connected to current paths which pass to the outside out of the insulating material housing, where they have an electrical connection for external connection of the switching device.

In the case of a single-interrupting rotating contact system, the contact lever has only one contact arm with one moving switching contact as the contact element. The associated fixed contact is once again connected to a current path which is passed out of the insulating material housing. Instead of the second contact arm, a current cable connection is provided, and is arranged in the area of the switching shaft segment. A current cable is then fitted between this and a second current path.

According to at least one embodiment of the invention, the contact element of the single-interrupting or double-interrupting rotating contact system can be switched off automatically via a switching mechanism such as this in the event of a fault.

The switching device may have a plurality of poles, in particular three poles. Said switching device may have two or more parallel-connected, rotatable contact levers for each pole, each having one or two contact arms as the contact element.

BRIEF DESCRIPTION OF THE DRAWINGS

The invention as well as advantageous embodiments of the invention will be described in more detail in the following text with reference to the following figures, in which.

DETAILED DESCRIPTION OF THE EXAMPLE EMBODIMENTS

Figure 1:
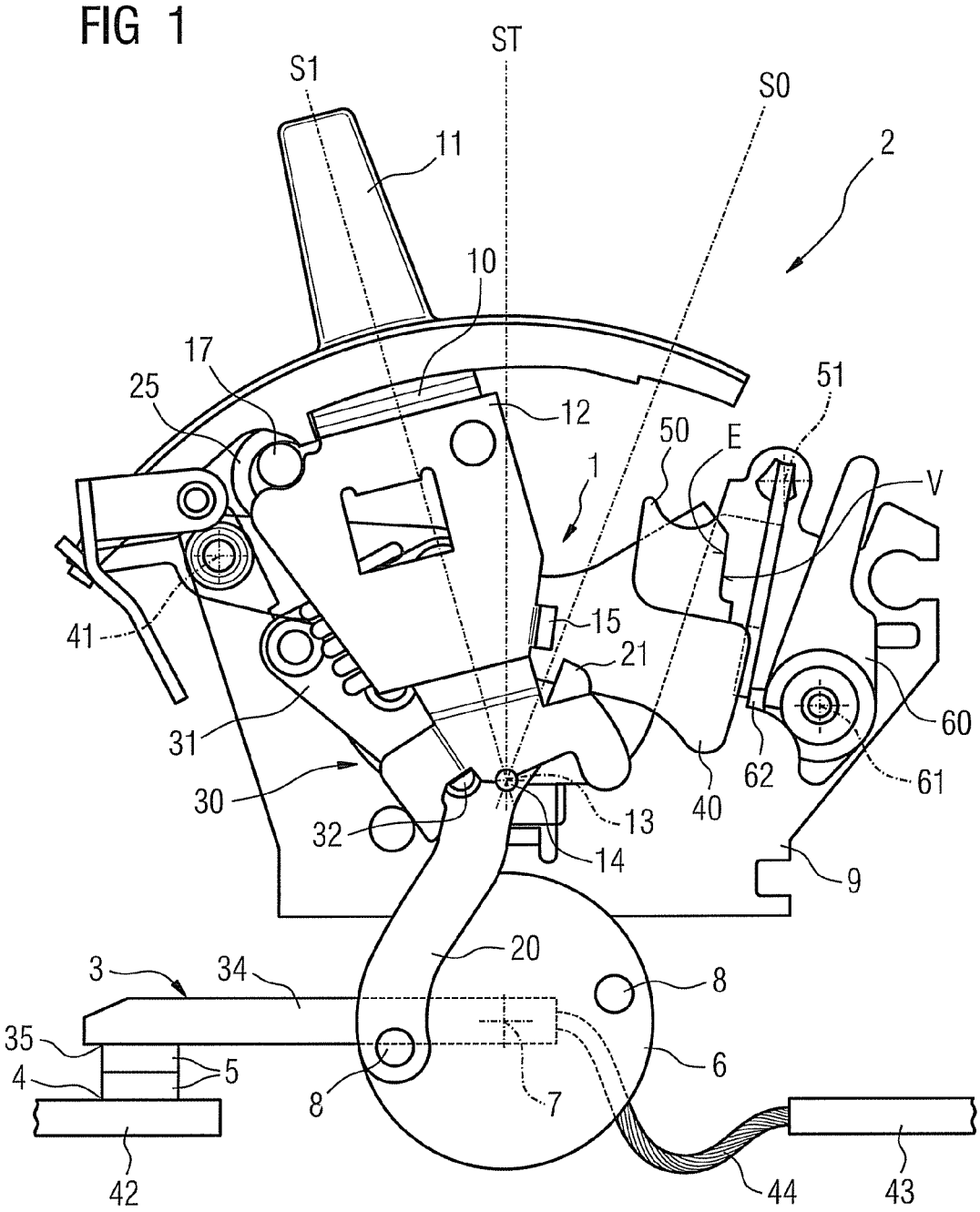
FIG. 1 shows a side view of a first embodiment of a switching mechanism according to the invention, in a switched-on position.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a side view of a first embodiment of a switching mechanism 1 according to the invention in a switched-on position S1.

FIG. 1 shows an example of a switching mechanism 1 for a switching device 2. The illustrated switching mechanism 1 is intended in particular for a low-voltage circuit breaker 2 and has a contact element 3 which is mounted in a switching shaft segment 6 and can be switched off automatically. The reference symbol 7 denotes a switching axis of the switching shaft segment 6. The contact element 3 has, for example, a single-armed contact lever 34 with a moving switching contact 35, with the latter interacting with a fixed contact 4 for connection to a current path 42. The end which is located at the other end of the current path 42 is typically in the form of an electrical connection, for example a terminal. Furthermore, a current cable connection is arranged in the area of the switching shaft segment 6 on the contact lever 34. The reference symbol 44 denotes a current cable which electrically connects the current cable connection to a further current path 43.

The illustrated switching mechanism 1, the fixed contact 4, the two switching paths 42, 43 and the current cable 44 are parts of the illustrated switching device 2 which, for example, is a single-interrupting device. As described above, this switching device 2 may also be in the form of a double-interrupting switching device. For clarity reasons, the figure does not show an insulating material housing on the switching device 2 itself. At the same time, a switching device 2 such as this may have a plurality of poles, in particular three poles, and may also have two or more parallel-connected, rotatable contact levers 34, each having one or two contact arms, for each pole.

The illustrated switching mechanism 1 according to an embodiment of the invention has a switching lever 10 for switching the contact element 3 on and off manually. The switching lever 10 and its switching link 12 can be tilted about a tilting axis 14, about a fixed-position bearing point 14. In this case, "fixed-position" means fixed to the housing or fixed with respect to two side plates 9, which are arranged parallel to one another, of the switching mechanism 1, although only one of the side plates 9 can be seen in the present side view. The switching link 12 is in the form of a bent and stamped sheet-metal part. A handle 11 composed of an insulating material is fitted to the upper end of the switching link 12, for manual operation of the switching lever 10.

S1 denotes an illustrated switched-on position, in which the switching contacts 4.35 of the switching device 2 are closed. ST denotes a tripped position or a so-called TRIP position. This switch position ST is typically assumed when the switching mechanism 1 or the switching lock is externally tripped via a release when in the switched-on position S1, by operating a latch 60 in the form of a lever. Finally, S0 denotes a manual switched-off position, in which the switching contacts 4, 35 have been opened.

Furthermore, the switching mechanism 1 has a cocking lever 40 which is mounted such that it can rotate about a fixed-position cocking lever axis 41 and has an opposite end, which interacts with a catch 50, for latching and unlatching the cocking lever 40. The reference symbol V denotes a corresponding latching surface of the cocking lever 40, and E denotes a corresponding catch contour on the catch 50. In this case, in the event of tripping, the catch 50 is unlatched via a latching tab 62 of the latch 60. This releases the prestressed cocking lever 40. The reference symbol 61 denotes a fixed-position latch axis of the latch 60, and 51 denotes a corresponding fixed-position catch axis.

Furthermore, the switching mechanism 1 has a toggle lever joint 30. This comprises a coupling lug 20 which is designed to be slightly S-shaped and flat, or else a lower toggle lever, a pivoting lever 31 and an upper toggle lever, and a toggle lever joint shaft 32 which connects them. In this case, the coupling lug 20 is connected in an articulating manner on the other side via a rotating bolt 8 to the contact element 3, and the pivoting lever 31 is connected in an articulated manner on the other side via a connecting shaft 33 to the cocking lever 40.

In addition, a spring element 25 in the form of a cylindrical spring is introduced between the toggle lever joint shaft 32, which is not in a fixed position, and the switching lever 10. The spring element 25 may also be referred to as a lock spring. In particular, the two spring ends, which are in the form of clips, are hooked in between an axially running spring bolt 17 of the switching link 12 and the toggle lever joint shaft 32, which likewise runs axially. In the illustrated switched-on position S1, the spring element 25 has already moved the toggle lever joint 30 to a prestressed extended position.

According to an embodiment of the invention, the coupling lug 20 has a hook piece 21 or blocking piece which is arranged in the area of the toggle lever joint shaft 32. In the first illustrated embodiment, the hook piece 21 rests on a lug end which is opposite the rotating bolt 8. The coupling lug 20, together with the hook piece 21, is already in the form of a stamped part. The hook piece 21 is intended to interact with a blocking element 15 of the switching link 12 such that, when tripping occurs and switching contacts 4, 35 are welded, the switching lever 10, which is pivoted from the switched-on position S1 in the direction of the tripped position ST, is held fixed in an intermediate switch position SV in between. The blocking element 15, which is shown in the example in FIG. 1, is a stamped-around, bent-around stamped and bent piece, and is formed at a tangential end of the switching link 12. Furthermore, the stamped and bent piece 15 is bent around such that it is aligned essentially parallel to the tilting axis 14.

When the switching mechanism 1 is in the present switched-on position S1, the hook piece 21 and the blocking element 15 do not interact.

Figure 2:
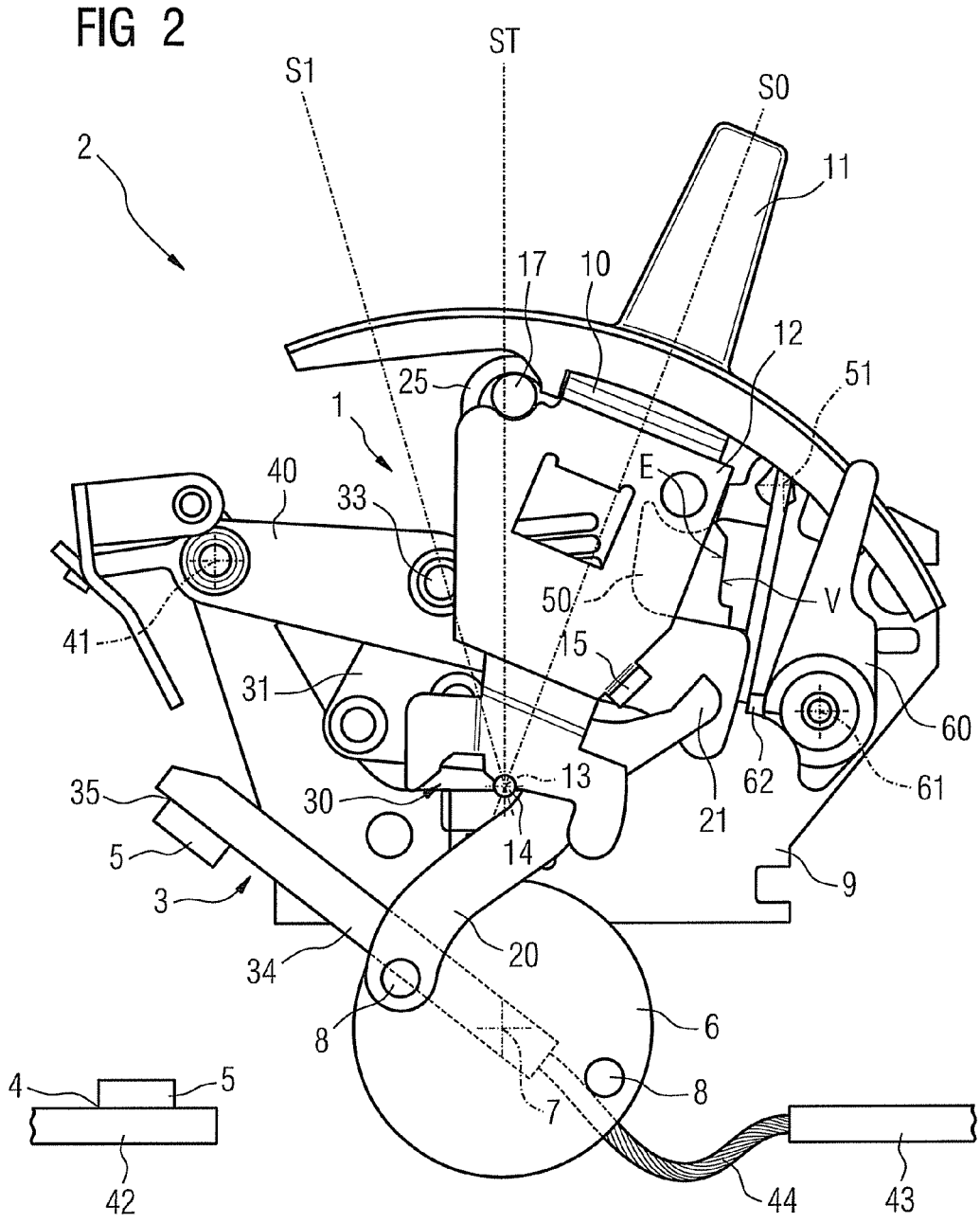
FIG. 2 shows the switching mechanism as shown in FIG. 1, in a manual switched-off position.

FIG. 2 shows the switching mechanism 1 as shown in FIG. 1 in a manual switched-off position S0. In this switch position S0, the spring element 25 moves the toggle lever joint 30 to an uncocked bent position. The two switching contacts 4, 35 are open. In this switch position S0 as well, the hook piece does not interact with the blocking element 15 when the contact element 3 is serviceable, that is to say it is not welded. In fact, the hook piece 21 moves past the blocking element 15 as a result of the switching mechanism 1 snapping over suddenly.

Figure 3:
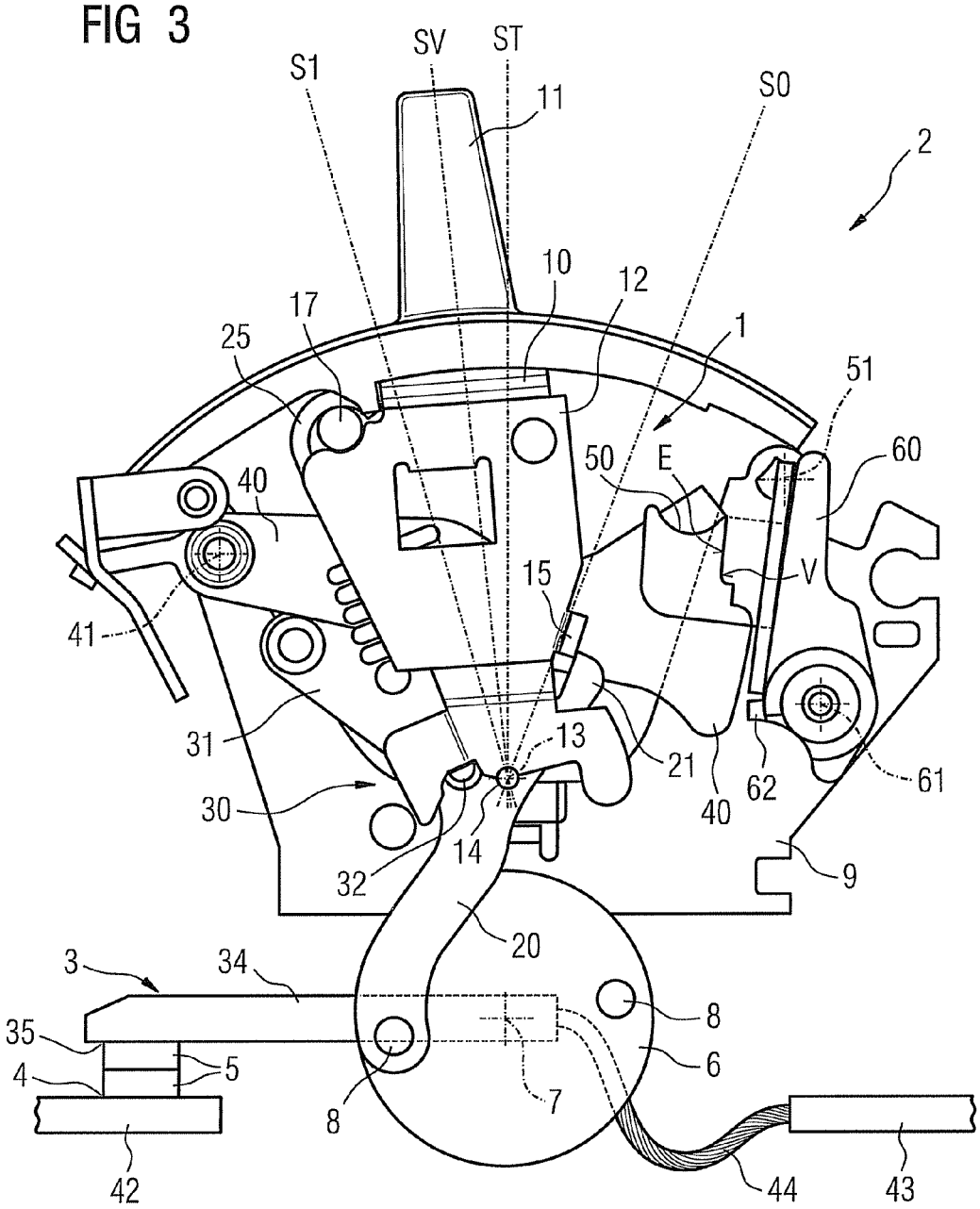
FIG. 3 shows the switching mechanism as shown in FIG. 1, after automatic unlatching, in the event of a welded contact element.

FIG. 3 shows the switching mechanism 1 as shown in FIG. 1 after an automatic unlatching when the contact element 3 is welded. In this case, the blocking element 15 interacts with the coupling lug 20 and with the hook piece 21 on the coupling lug 20 such that, according to the invention, the switching lever 10 now remains in the intermediate switch position SV throughout an opening operating process. This is because the switching shaft segment 6 can rotate only through a relatively small rotation angle in comparison to a correct opening operating process, and the spring element 25 therefore pulls the toggle lever joint 30 to the extended position. As a consequence of this, the coupling lug 20 is pulled into the illustrated position, in which it can then block the switching link 12. The hook piece 21 and the blocking element 15 are now engaged.

If the blocking element 15 of the switching link 12 and the hook piece 21 of the coupling lug 20 are designed to be mechanically particularly robust, then a user can make at least one attempt to break open the welded contact element 3. To do this, the switching lever 10 must then be pushed manually from the intermediate switch position SV in the direction of the switched-off position S0, in order to open the welded switching contacts 4, 35.

Figure 4:
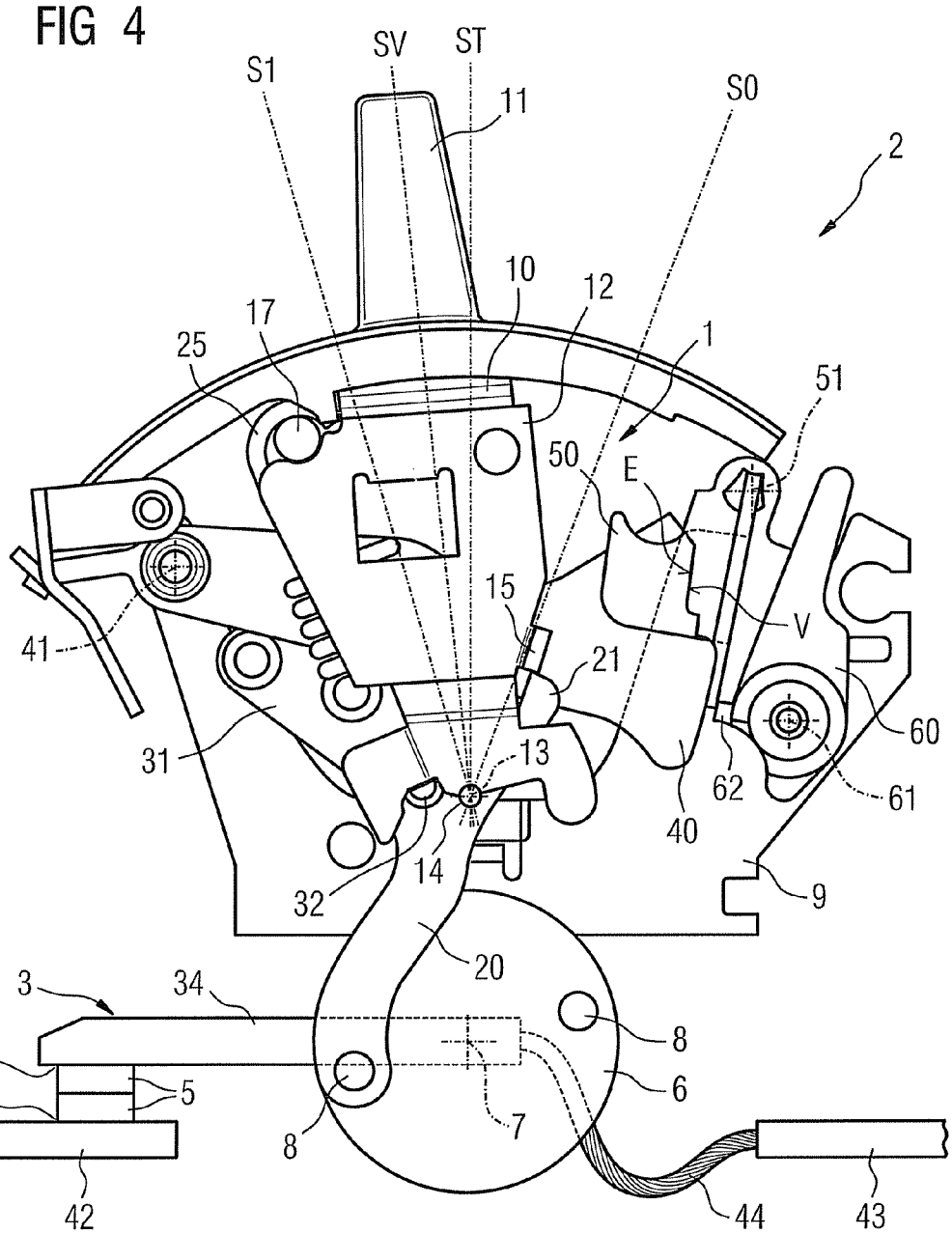
FIG. 4 shows, in comparison to this, the switching mechanism as shown in FIG. 1, for a serviceable contact element, on reaching the same switch position.

In comparison to this, FIG. 4 shows the switching mechanism 1 as shown in FIG. 1 on reaching the same switch position, when the contact element 3 is serviceable. As can be seen, the toggle lever joint 30 is pulled to a lesser extent to the extended position and, in consequence, the coupling lug 20 has also been "pulled up" to a lesser extent. The hook piece 21 therefore actually does not interact with the blocking element 15 of the switching link 12, and the switching link 12 can now pivot further to the tripped position ST, without any impediment.

Figure 5:
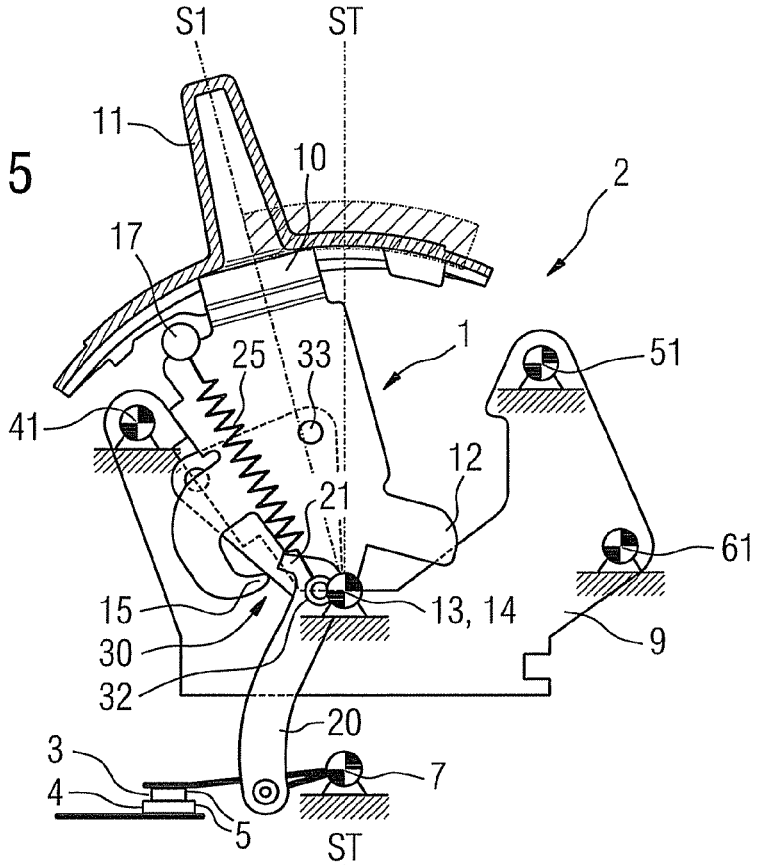
FIG. 5 shows a side view of a second embodiment of the switching mechanism according to the invention, in a switched-on position.

FIG. 5 shows a side view of a second embodiment of the switching mechanism 1 according to the invention in a switched-on position S1. In comparison to the previous embodiment shown in FIG. 1 to FIG. 4, the blocking element 15 and the hook piece 21 are arranged at the other tangential end with respect to the tilting axis 14. In this case, by way of example, the blocking element 15 is sickle-shaped. The blocking element 15 and the hook piece 21 do not engage with one another.

Figure 6:
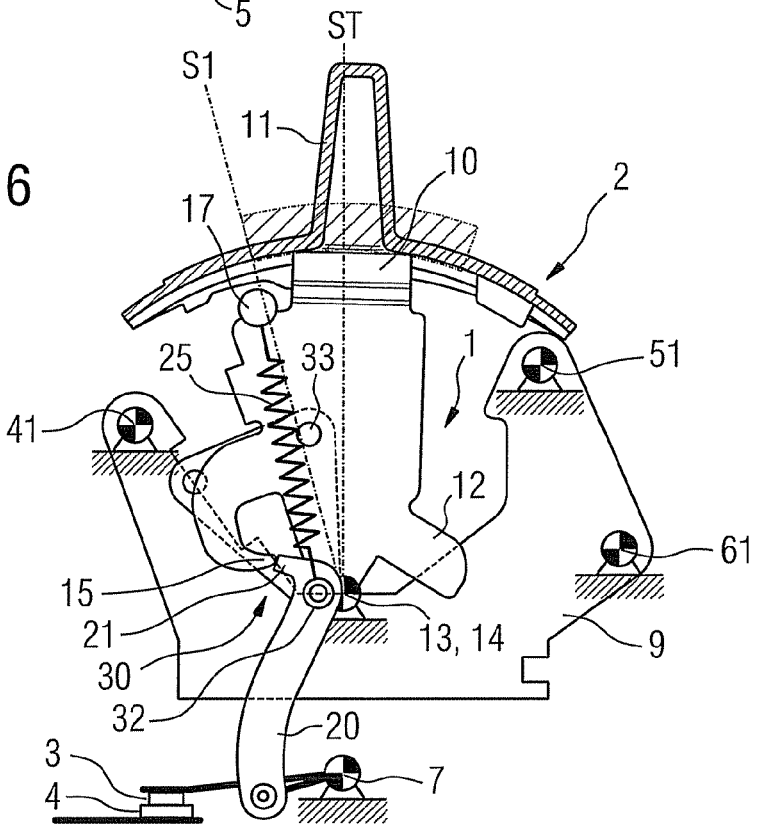
FIG. 6 shows the switching mechanism shown in FIG. 5 in a cocked, correct tripped position with a closed contact element.

FIG. 6 shows the switching mechanism 1 as shown in FIG. 5 in a correct tripped position ST, in the cocked state, that is to say with the cocking lever latched. The cocking lever is not itself shown in this illustration, for clarity reasons. In the cocked state, automatic external tripping of the switching mechanism 1 is possible in order to open the switching contacts 4, 35. As in FIG. 6, the blocking element 15 and the hook piece 21 do not engage with one another in this case, either.

Figure 7:
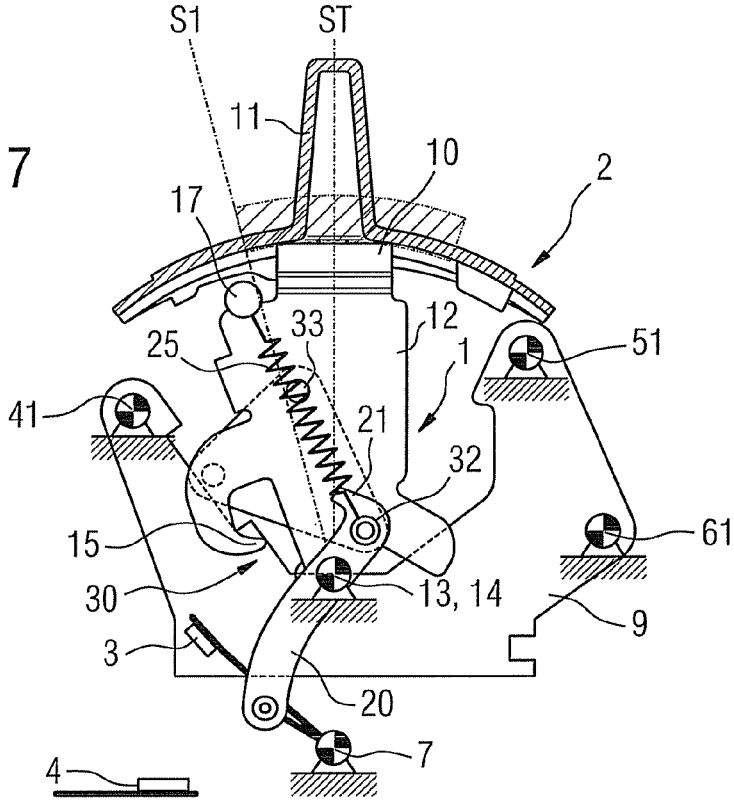
FIG. 7 shows the switching mechanism as shown in FIG. 6, in an uncocked, correct tripped position with an open contact element.

FIG. 7 shows the switching mechanism 1 as shown in FIG. 6 in a correct tripped position ST in the uncocked state, that is to say with the cocking lever unlatched. The switching contacts 4, 35 are now open as a result of the rotation of the switching shaft segment 6. At the same time, the blocking element 15 and the hook piece 21 are at the maximum distance from one another.

Figure 8:
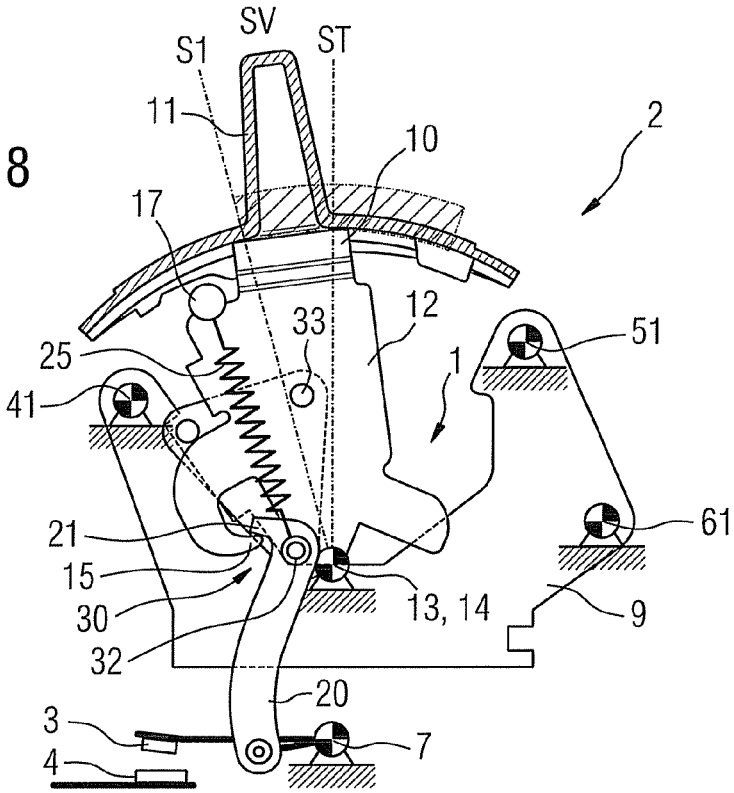
FIG. 8 shows the switching mechanism as shown in FIG. 5, in an intermediate switch position, in the event of a contact element being welded.

FIG. 8 shows the switching mechanism 1 as shown in FIG. 5, in an intermediate switch position SV in the event of tripping with a welded contact element 3. Because the toggle lever joint 30 is in an extended position, the hook piece 21 is now engaged with the blocking element 15. The switching link 12 and therefore also the switching lever 10 remain in the illustrated intermediate switch position SV.

Figure 9:
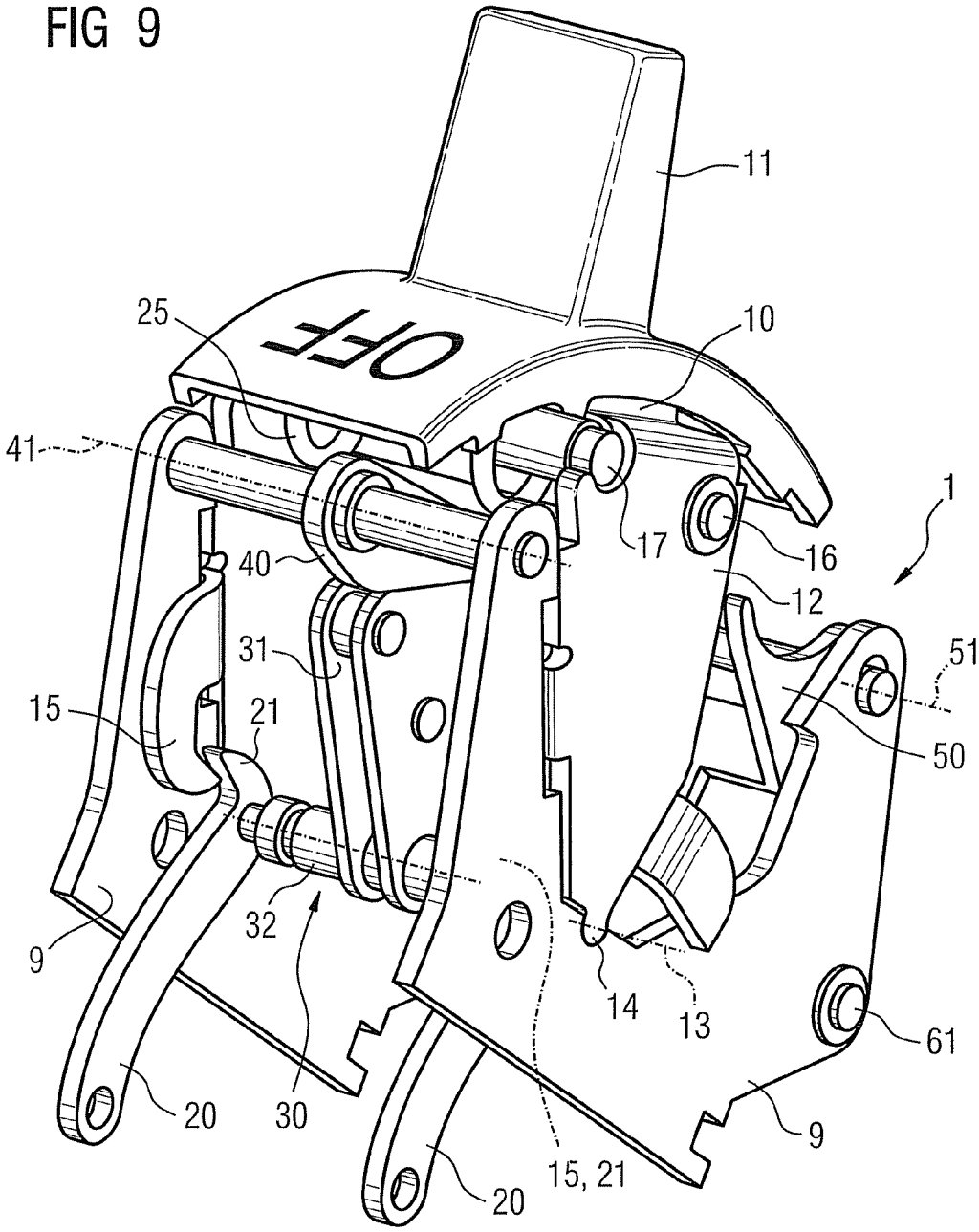
FIG. 9 shows a perspective view of the switching mechanism as shown in FIG. 5.

FIG. 9 shows a perspective view of the switching mechanism 1 as shown in FIG. 5. In this illustration, the two side plates 9 which are arranged parallel to one another and are firmly connected to one another at least via the bolts 17, 51, 61 can be regarded as fixed-position components of the switching device 1 according to an embodiment of the invention. After assembly, for articulated connection to the switching shaft segment, the entire switching mechanism 1 is inserted into a insulating material housing of the switching device.

The illustrated switching mechanism 1 is designed to be mirror-image symmetrical, with the perpendicular to the plane of the mirror running parallel to the tilting axis 14 of the switching mechanism 1. The mirror-image design, which is advantageously mechanically more robust, in consequence also results in twice the number of blocking elements 15 and hook pieces 21 or coupling lugs 20.

Although the invention has been illustrated and described in relatively great detail using the example embodiments, the invention is not restricted to the disclosed examples, and other variations may be derived by a person skilled in the art without departing from the scope of protection of the invention.

In summary, at least one embodiment of the invention relates to a switching mechanism 1 for a switching device 2. The switching mechanism 1 has a contact element 3 which is mounted in a switching shaft segment 6 such that it can rotate and can be switched off automatically in the event of a fault via this switching mechanism 1, a switching lever 10 for switching the contact element 3 on and off manually, a cocking lever 40 which is mounted in a fixed position such that it can rotate and interacts with a catch 50, as well as a toggle lever joint 30, comprising a coupling lug 20 for connection to the coupling element 3, a pivoting lever 31 and a toggle lever joint shaft 32. The switching lever 10 can assume at least one switched-on position S1, a manual switched-off position S0 or automatically unlatched tripped position ST or an intermediate switch position SV which is located between the switched-on position S1 and the tripped position ST when a contact element is welded. According to at least one embodiment of the invention, the switching link 12 of the switching lever 10 has at least one blocking element 15, which interacts with the coupling lug 20 such that the switching lever 10 remains in the intermediate switch position SV if an opening operation is carried out when a contact element 3 is welded.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Switching mechanism, switching lock
2 Switching device
3 Contact element
4 Fixed contact, switching contact
5 Switching pieces
6 Switching shaft segment, switching shaft
7 Switching axis, rotation axis
8 Rotating bolt
9 Base support, side plates
10 Switching lever
11 Handle
12 Switching link
13 Tilting axis
14 Bearing point
15 Block, blocking hook
17 Spring bolt
20 Coupling lug
21 Lug piece, lug end piece
30 Toggle lever joint
31 Pivoting lever
32 Toggle lever joint shaft
33 Connecting shaft
34 Contact arm
35 Moving switching contact, switching contact
40 Cocking lever
41 Cocking lever axis
42, 43 Current paths
44 Current cable
50 Catch
51 Catch axis
60 Latch
61 Latch axis
62 Latching tab
S0 Switched-off position
S1 Switched-on position
ST Tripped position, trip position
SV Intermediate switch position when switching contacts are welded
E Catch contour
V Latching surface

What is claimed is:

1. A switching mechanism for a switching device, comprising:

at least one contact element mounted in a switching shaft segment and automatically switchable off in the event of a fault via the switching mechanism;

a switching lever for switching the at least one contact element on and off manually, including a switching link which is tiltable about a fixed-position bearing point;

a cocking lever, mounted to be rotatable about a fixed-position cocking lever axis and including an opposite end, which interacts with a catch, for latching and unlatching the cocking lever;

a toggle lever joint, comprising a coupling lug, a pivoting lever and a toggle lever joint shaft which connects the coupling lug and the pivoting lever, wherein the coupling lug is connected on another side to the contact element and wherein the pivoting lever is connected on the another side to the cocking lever; and a spring element, introduced between the toggle lever joint shaft and the switching lever, wherein at least one switched-on position is assumable by the switching lever, wherein the spring element moves the toggle lever joint to an extended position, a manual switched-off position or automatically unlatched tripped position, wherein the spring element moves the toggle lever joint to a bent position or an intermediate switch position which is located between the switched-on position and the tripped position when a contact element is welded, the switching link of the switching lever including at least one blocking element which interacts with the coupling lug such that the switching lever remains in the intermediate switch position if an opening operation is carried out when a contact element is welded.

2. The switching mechanism as claimed in claim 1, wherein the coupling lug includes a hook piece which is arranged in an area of the toggle lever joint shaft.

3. The switching mechanism as claimed in claim 2, wherein the coupling lug, together with the hook piece, is a stamped part.

4. The switching mechanism as claimed in claim 2, wherein the at least one blocking element of the switching link and the hook piece of the coupling lug are mechanically designed to withstand loads such that at least one attempt can be made to break open the welded contact element by manual operation of the switching lever in the direction of the switched-off position.

5. The switching mechanism as claimed in claim 3, wherein the at least one blocking element of the switching link and the hook piece of the coupling lug are mechanically designed to withstand loads such that at least one attempt can be made to break open the welded contact element by manual operation of the switching lever in the direction of the switched-off position.

6. The switching mechanism as claimed in claim 1, wherein the switching link is a stamped and bent part, and wherein the at least one blocking element is a stamped-around, bent-around stamped and bent piece.

7. The switching mechanism as claimed in claim 6, wherein the stamped and bent piece is formed at a tangential end of the switching link.

8. The switching mechanism as claimed in claim 7, wherein the at least one blocking element of the switching link and the hook piece of the coupling lug are mechanically designed to withstand loads such that at least one attempt can be made to break open the welded contact element by manual operation of the switching lever in the direction of the switched-off position.

9. The switching mechanism as claimed in claim 6, wherein the at least one blocking element of the switching link and the hook piece of the coupling lug are mechanically designed to withstand loads such that at least one attempt can be made to break open the welded contact element by manual operation of the switching lever in the direction of the switched-off position.

10. A switching device comprising:

a double-interrupting or single-interrupting rotating contact system which is accommodated in an insulating material housing;

two fixed contacts, each for connection to a respective current path; and a contact element, mounted in a switching shaft segment to be rotatable and interact with at least one of the fixed contacts, wherein the contact element is automatically switchable off in the event of a fault via the switching mechanism as claimed in claim 1.

11. The switching device as claimed in claim 10, wherein the switching device includes a plurality of poles.

12. The switching device as claimed in claim 11, wherein the switching device includes three poles.

13. The switching device as claimed in claim 12, wherein the switching device includes two or more parallel-connected contact levers for each pole, each having one or two contact arms as the contact element.

14. The switching device as claimed in claim 11, wherein the switching device includes two or more parallel-connected contact levers for each pole, each having one or two contact arms as the contact element.

15. The switching device as claimed in claim 10, wherein the switching device includes two or more parallel-connected contact levers for each pole, each having one or two contact arms as the contact element.

16. The switching mechanism as claimed in claim 1, wherein the switching mechanism for a low-voltage circuit breaker.

17. A switching device comprising the switching mechanism as claimed in claim 1.

18. A low voltage circuit breaker comprising the switching mechanism as claimed in claim 1.

* * * * *